US011464318B2

(12) United States Patent
Leonard

(10) Patent No.: US 11,464,318 B2
(45) Date of Patent: Oct. 11, 2022

(54) COSMETIC PRODUCT APPLICATOR AND ASSOCIATED APPLICATION PROCESS

(71) Applicant: L'OREAL, Paris (FR)

(72) Inventor: Alexis Leonard, Clichy (FR)

(73) Assignee: L'OREAL, Paris (FR)

( * ) Notice: Subject to any disclaimer, the term of this patent is extended or adjusted under 35 U.S.C. 154(b) by 611 days.

(21) Appl. No.: 16/343,196

(22) PCT Filed: Oct. 24, 2017

(86) PCT No.: PCT/EP2017/077196
§ 371 (c)(1),
(2) Date: Apr. 18, 2019

(87) PCT Pub. No.: WO2018/077895
PCT Pub. Date: May 3, 2018

(65) Prior Publication Data

US 2019/0239621 A1 Aug. 8, 2019

(30) Foreign Application Priority Data

Oct. 24, 2016 (FR) ..... 1660300

(51) Int. Cl.
*A45D 40/26* (2006.01)

(52) U.S. Cl.
CPC ..... *A45D 40/265* (2013.01); *A45D 40/264* (2013.01)

(58) Field of Classification Search
CPC .. A45D 40/267; A45D 40/264; A45D 34/045; A45D 34/041; A45D 40/265;
(Continued)

(56) References Cited

U.S. PATENT DOCUMENTS 4,056,111 A * 11/1977 Mantelet ..... A45D 34/045 132/218
4,377,013 A * 3/1983 Tuller ..... A46B 13/08 15/25

(Continued)

FOREIGN PATENT DOCUMENTS

DE 195 19 206 A1 11/1996
EP 1 369 056 A1 12/2003

(Continued)

OTHER PUBLICATIONS

Search Report dated Mar. 29, 2017 in FR 1660300.
Search Report dated Nov. 22, 2017 in PCT/EP2017/077196.

*Primary Examiner* — Yogesh P Patel
*Assistant Examiner* — Jennifer Gill
(74) *Attorney, Agent, or Firm* — Polsinell PC

(57) ABSTRACT

This invention relates to a cosmetic product applicator (14) including: —a gripping member (16) extending along a longitudinal axis (A), —a rod carrier (18) arranged in the gripping member (16), —a rod (20) secured to the rod carrier (18) and —a cosmetic product application member (22) carried by the rod (20), the rod carrier being (18) mounted mobile in rotation about the longitudinal axis (A) with respect to the gripping member (16), The rod carrier (18) has a first and a second circumferential linear contact region (86, 90) with the gripping member (16) about the longitudinal axis (A) and a second circumferential linear contact region (86, 90) with the gripping member (16) about the longitudinal axis (A), the rod carrier (18) being arranged totally apart from the gripping member (16) in an intermediate region (92) between the first linear contact region (86) and the second linear contact region (90).

20 Claims, 3 Drawing Sheets

Figure 1:
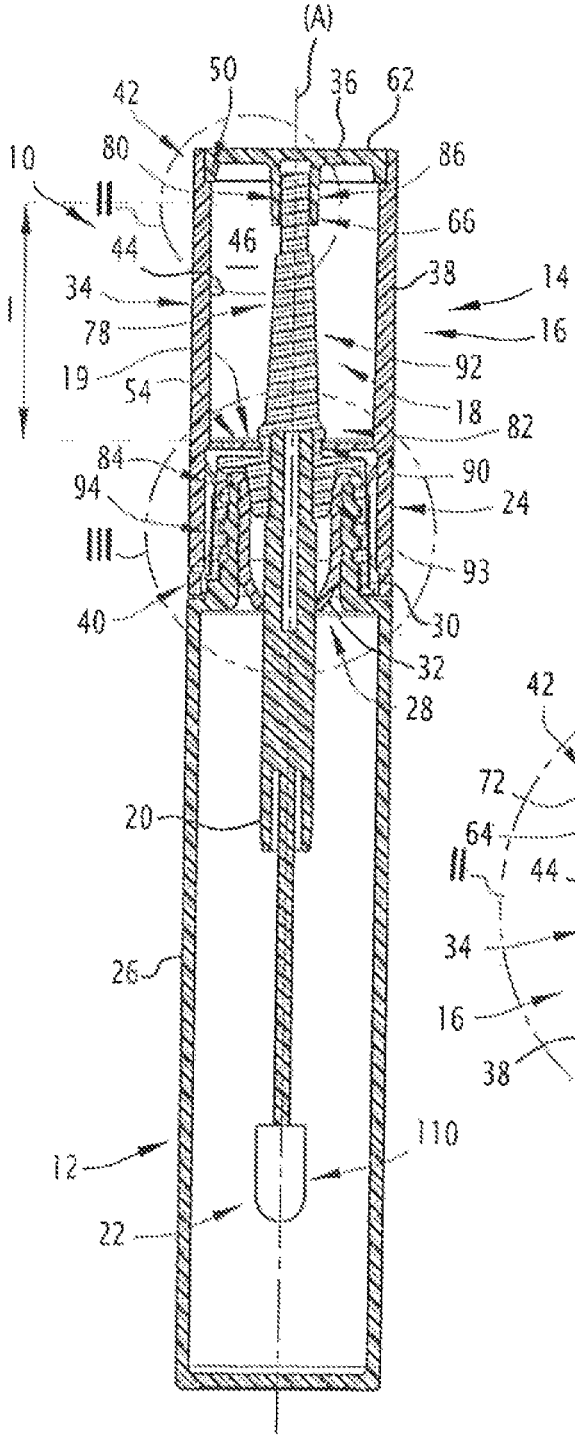

(58) Field of Classification Search
CPC .. A45D 34/042; A45D 34/043; A45D 40/262; A46B 9/021; A46B 2200/1053; A46B 13/04; A46B 13/08
See application file for complete search history.

(56) References Cited

U.S. PATENT DOCUMENTS 4,397,326 A * 8/1983 Formica ..... A45D 40/26 132/218
5,027,838 A * 7/1991 Iaia ..... A45D 40/265 132/218
5,492,136 A * 2/1996 Edmonds ..... A45D 2/48 132/112
6,145,514 A * 11/2000 Clay ..... A45D 40/265 132/218
7,165,906 B2 * 1/2007 Dieudonat ..... A45D 40/265 401/126
8,529,147 B2 * 9/2013 Delage ..... A45D 40/267 401/127
2004/0009028 A1 * 1/2004 Gueret ..... A45D 40/265 401/129
2009/0194127 A1 * 8/2009 Pires ..... A45D 40/265 132/218
2011/0100866 A1 * 5/2011 Gueret ..... A46B 15/0002 206/581
2016/0128457 A1 * 5/2016 Lim ..... A46B 9/021 401/118
2018/0249812 A1 * 9/2018 Kim ..... A46B 9/026

FOREIGN PATENT DOCUMENTS

EP 1 917 883 A2 5/2008
FR 2 995 768 A1 3/2014
FR 3013193 * 5/2015
FR 3 021 511 A1 12/2015
KR 20-0439644 * 4/2008

* cited by examiner

COSMETIC PRODUCT APPLICATOR AND ASSOCIATED APPLICATION PROCESS

CROSS REFERENCE TO RELATED APPLICATIONS

This application is a National Phase filing under 35 U.S.C. § 371 of PCT/EP2017/077196 filed on Oct. 24, 2017; and this application claims priority to Application No. 16 60300 filed in France on Oct. 24, 2016. The entire contents of each application are hereby incorporated by reference.

This invention relates to a cosmetic product applicator including a gripping member extending along a longitudinal axis, a rod carrier arranged in the gripping member, a rod secured to the rod carrier and a member for the application of a cosmetic product carried by the rod, the rod carrier being rotatably mounted about the longitudinal axis with respect to the gripping member.

The cosmetic product is for example a makeup product such as a mascara, a care product, or a cleansing product.

By "cosmetic product", in the sense of this invention, we more generally mean for example a product as defined in (EC) Regulation no. 1222/2009 of the European Parliament and the Council of Nov. 30, 2009, relating to cosmetic products.

The application member is intended to apply the cosmetic product on keratinous fibers of a user, for example on the eyelashes in the case of a mascara. The application member then comprises a brush attached to the distal end of the rod.

In a known manner, the applicator is movable between an idle position, mounted in a receptacle containing the cosmetic product, and a usage position extracted from the receptacle.

To use the applicator, the user withdraws the rod and the brush from the receptacle, with the brush being loaded with product. The user applies the brush on the eyelashes, by imparting to the rod a brushing movement of the eyelashes. The cosmetic product is deposited on the eyelashes.

In order to facilitate the application of the cosmetic product, applicators of the type described in FR 2 968 518 have been developed.

In these applicators, the rod is rotative with respect to the gripping member, with the possibility of braking the rotation by acting via friction, either directly on the rod in rotation, or by interposition of a braking element. During the application of the product with these applicators, the rotation of the rod is caused by the adherence of the brush on the eyelashes.

Such an applicator however does not provide full satisfaction. When it is used, the brush is indeed able to rub without rolling on the eyelashes, which limits the quantity of product deposited on the eyelashes at each application pass, as well as the uniformity and the degree of curvature conferred to the eyelashes in terms of a given number of application passes, for example about 30 passes.

A purpose of the invention is therefore to propose a cosmetic product applicator that more effectively applies the cosmetic product and in particular allows for an improved forming of the keratinous fibers, in particular in terms of elongation and curvature.

To this effect, the invention has for object an applicator of the aforementioned type, characterized in that the rod carrier has a first circumferential linear contact region with the gripping member about the longitudinal axis and a second circumferential linear contact region with the gripping member about the longitudinal axis, the rod carrier being arranged totally apart from the gripping member in an intermediate region between the first linear contact region and the second linear contact region.

The supply of two circumferential linear contact regions between the rod carrier and the gripping member substantially limits the phenomena of friction between the application member, such as a brush, and the keratinous fibers or the skin in order to obtain a quasi-pure rolling of this application member on the keratinous fibers or on the skin. This generates an improved deposit of the product for a reduced number of applications, a more substantial elongation of the keratinous fibers and a curvature that is more aesthetic where applicable. Moreover, as the friction internal to the applicator is decreased, this invention makes it possible to minimize the force exerted by the user in order to cause the application member to roll, and in particular the brush on the keratinous fibers or on the skin and as such improve the facility of application.

Advantageously, the applicator comprises a blocking device that opposes the translation along the axis A of the rod carrier with respect to the gripping member.

This blocking device limits the relative translation along the axis A of the rod carrier with respect to the gripping member to a functional gap between these elements, preferably less than 2 mm, in particular less than 1 mm and in particular close to 0.7 mm, even close to 0.5 mm.

A pivot connection with reduced statically indeterminate is as such created between the rod carrier and the gripping member by associating an annular linear connection of axis A between these two elements on the level of each one of the first and second linear contact regions and a blocking in translation along the axis A between these two elements. The statically indeterminate reduction in the assembly between the rod carrier and the gripping member minimized the existing friction between these two elements and as such favors the free rotation of the rod carrier with respect to the gripping member, with the aforementioned advantageous effects on the results of the application of the cosmetic product.

According to an advantageous arrangement, the blocking device is formed by a first axial stop surface provided on the rod carrier in contact with a second axial stop surface provided on the gripper member. Preferably, the first and second axial stop surfaces are adjacent along the axis A at one at least of the first and second circumferential linear contact regions.

Alternatively, the blocking device authorizes a certain relative translation travel along the axis A of the rod carrier with respect to the gripping member, for example a travel less than 10 mm, in particular between 4 mm and 6 mm.

Advantageously, an elastic element is arranged between the rod carrier and the gripping member. This elastic element is arranged in such a way that the relative translation along the axis A is carried out, at least in one direction of translation of the rod carrier with respect to the gripping member, against an elastic force exerted by the elastic element. The elastic element is as such arranged in such a way as to obtain a damping effect of the relative translation along the axis A of the rod carrier with respect to the gripping member, at least in a direction of translation along the axis A.

Advantageously, in the intermediate region, the rod carrier and the gripping member define a radial gap at least equal to 5%, preferably at least equal to 10%, and more preferably equal to at least 50% of the maximum radial dimension presented by the rod carrier, over at least 50% of the length of the intermediate region.

A functional radial gap, i.e. circumferential linear contact region a functional gap in the radial direction, exists between the rod carrier and the gripping member in the first and/or in the second circumferential linear contact region. Preferably, this functional radial gap is less than 0.5 mm, more preferably less than 0.2 mm and in particular in the neighborhood of 0.1 mm. The term "functional radial gap" between two elements here means the clearance/travel in the possible radial direction between these two elements in a considered region. As such, when the rod carrier and the gripping member are placed coaxially to one another, a gap in the radial direction exists on either side of the rod carrier, between the rod carrier and the gripping member, in the first circumferential linear contact region and/or in the second circumferential linear contact region, with this gap substantially corresponding to half of the aforementioned functional radial gap.

Advantageously, in the intermediate region, the rod carrier and the gripping member define a radial gap, i.e. a gap in the radial direction, greater than or equal to 1.1 times, preferably 1.5 times, the functional radial gap defined between the rod carrier and the gripping member in the first circumferential linear contact region and/or in the second circumferential linear contact region, over at least 50% of the length of the intermediate region. The term "radial gap" in the intermediate region between the rod carrier and the gripping member here means the distance in the radial direction that separates the rod carrier and the gripping member on the intermediate region, on one side and the other of the longitudinal axis, when these two elements are arranged coaxially. As such, if the functional radial gap between the rod carrier and the gripping member in the first circumferential linear contact region and/or in the second circumferential linear contact region is for example 0.1 mm, then the radial gap between the rod carrier and the gripping member in the intermediate region, on one side and the other of the longitudinal axis when the rod carrier and the gripping member are arranged coaxially, is greater than or equal to 0.11 mm, and preferably greater than or equal to 0.15 mm.

The radial separation between the rod carrier and the gripping member in the intermediate region, i.e. outside of the first and second linear contact region, makes it possible to have contact that can generate friction between the rod carrier and the gripping member only in the first and second contact regions.

The minimum distance between the first linear contact region and the second linear contact region is greater than or equal to 2 times the average diameter between the diameter of the rod carrier in the first linear contact region and the diameter of the rod carrier in the second linear contact region.

The guiding in rotation about the axis A of the rod carrier with respect to the gripping member is as such correctly provided, without rotation of the rod carrier with respect to the gripping member about axes perpendicular to the axis A. This minimum distance creates a sliding pivot connection of axis A between the rod carrier and the gripping member. This sliding pivot connection of axis A, combined with the blocking device in translation according to axis A of the rod carrier with respect to the gripping member, forms a pivot connection of axis A between the rod carrier and the gripping member.

Each linear contact region has a contact length taken along the longitudinal axis less than 5%, preferably less than 2% of the minimum distance between the first linear contact region and the second linear contact region.

Each linear contact region has a contact length taken along the longitudinal axis less than 5%, preferably less than 2% of the maximum diameter of the rod carrier in the linear contact region.

The reduced contact length between the rod carrier and the gripping member in each one of the contact regions with respect to the separation of these contact regions and/or with respect to the maximum radial dimension of the rod carrier in the first linear contact region and in the second linear contact region reducing the statically indeterminate that exists within the applicator such as disclosed hereinabove.

The gripping member comprises an inner sleeve, delimiting a cavity in which the rod carrier is received, the inner sleeve comprising a bulge, the first linear contact region extending opposite the bulge.

The gripping member comprises a peripheral wall about the longitudinal axis and at least one contact tongue radially protruding from the peripheral wall, the or each contact tongue defining a free inner edge directed towards the longitudinal axis, the second linear contact region extending opposite the free edge.

The rod carrier defines a circumferential groove that receives the free edge of the or each contact tongue.

The gripping member comprises a transverse wall that defines a plurality of radial slots, the radial slots delimiting between them at least two contact tongues located facing the second linear contact region.

The gripping member comprises a plug and a cover, the plug being attached to the cover, the first linear contact region being delimited opposite the plug, the second linear contact region being delimited opposite the cover.

These particular shapes of creating circumferential linear regions are particularly adapted and easily produced for example via molding.

The contact tongues can be deformed and facilitate the assembly of the rod carrier to the gripping member, via simple snap-fitting in the circumferential groove of the rod carrier.

The applicator comprises a locking system for the selective rotational locking of the rod carrier with respect to the gripping member operable between an inactive configuration, in which the rod carrier is freely rotating about the longitudinal axis, and an active configuration, in which the rod carrier is locked in rotation.

The locking system comprises splines arranged on an external peripheral surface of the rod carrier, and at least one flexible tab mounted mobile on the gripping member, the flexible tab comprising at least one locking cog able to be inserted into a spline in order to lock the rod carrier in rotation with respect to the gripping member.

The presence of the locking system for the selective rotational locking carried out advantageously by cooperation between splines and a stop allows a complete rotational locking, for example in order to carry out a conventional application of product, without rotation of the rotating member. Furthermore, the total rotational locking is very useful for withdrawing the application member outside of the receptacle. The term total rotational locking here means a "frank" contact of elements abutting against one another, and not only a friction contact.

Each flexible tab is defined by a cut made through the gripping member, the locking system comprising a flexible hinge, the flexible tab being connected to the gripping member by the flexible hinge.

The locking system comprises a deformable seal arranged in the cut around the or each flexible tab in order to close off the cut at the periphery of the flexible tab.

The formation of a cut in the gripping member simplifies the manufacture of the locking system. The over-molding of a deformable seal in the cut prevents the intrusion of particles or pollutants into the gripping member.

Advantageously, the rod carrier is arranged entirely apart from the gripping member outside of the first linear contact region and the second linear contact region.

The rod carrier is in contact with the gripping member only in the circumferential linear contact regions.

Preferably, the rod carrier is locked along any rotation following an axis perpendicular to the longitudinal axis of the gripping member.

The invention also relates to a packaging and application device for a cosmetic product comprising a receptacle intended to contain the cosmetic product, and an applicator described hereinabove removably mounted onto the receptacle.

The applicator according to the invention is able to be removably mounted onto the receptacle by cooperation of a threading provided on the receptacle, in particular on the neck of the receptacle, with an internal thread provided on the applicator, in particular on the rod carrier. In such a case, and when the applicator is provided with a system for the selective rotational locking of the rod carrier with respect to the gripping member, the user who wants to use the applicator grasps the gripping member, actuates the system for the rotational locking in order to secure the gripping member and the rod carrier in rotation, then unscrews the unit forms by the gripping member and the rod carrier and extracts the applicator outside of the receptacle.

Alternatively, and according to an advantageous arrangement, the applicator according to the invention is able to be removably mounted onto the receptacle by means of a snap-fitting or magnetism system, or by any other system that does not require a relative rotation of the applicator with respect to the receptacle in order to separate these two elements. Thanks to these arrangements, the ergonomics of the packaging and application device is improved, by avoiding imposing on the user a step of actuating the system for the selective rotational locking of the rod carrier with respect to the gripping member, in addition avoiding the need to implement such a system within the applicator, in order to separate the applicator from the receptacle.

The invention also relates to a process for applying a cosmetic product on keratinous fibers of a user comprising at least the following steps:

- providing a device such as described hereinabove;
- detaching the applicator apart from the receptacle;
- bringing the cosmetic product application member in contact with the keratinous fibers;
- driving in rotation the application member, the rod and the rod carrier with respect to the gripping member by displacing the application member on the keratinous fibers, the rod carrier coming into contact with the gripping member, and depositing cosmetic product on the keratinous fibers.

The process according to the invention may have the following feature: the applicator comprises a locking system for the selective rotational locking of the rod carrier with respect to the gripping member operable between an inactive configuration, in which the rod carrier is freely rotating about the longitudinal axis, and an active configuration, in which the rod carrier is locked in rotation, the process comprising a step of rotational locking of the rod carrier with respect to the gripping member by passing the locking system from the inactive configuration to the active configuration.

Implementing the process according to the invention is very effective in terms of loading product, which is improved for a reduced number of applications. Furthermore, a significant aesthetic effect is produced, which results from the increase in the protruding angle of the keratinous fibers with respect to the horizontal.

Figure 2:
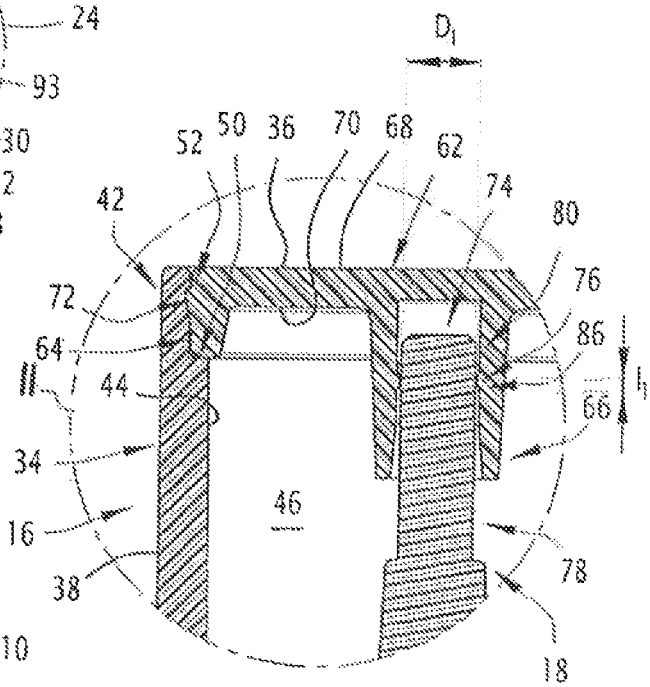
Figure 3:
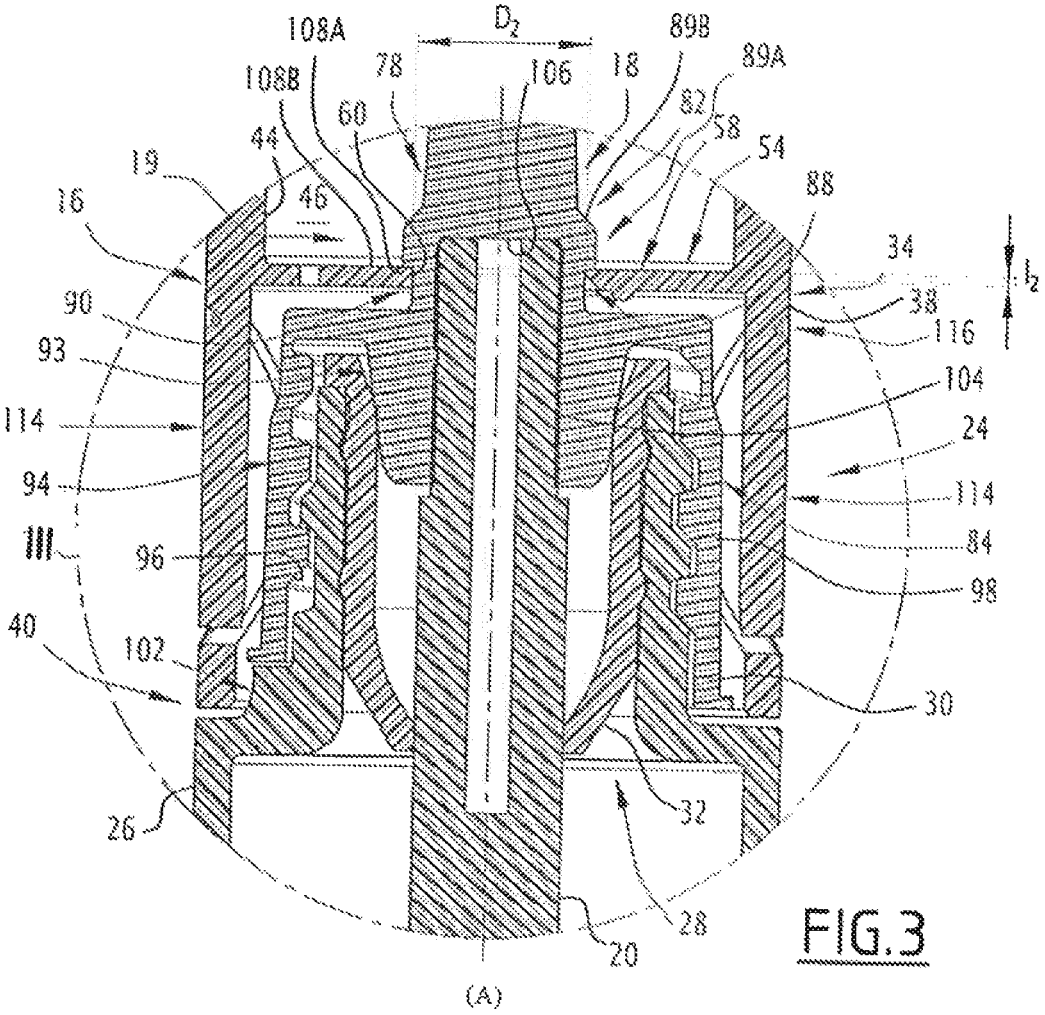
Figure 4:
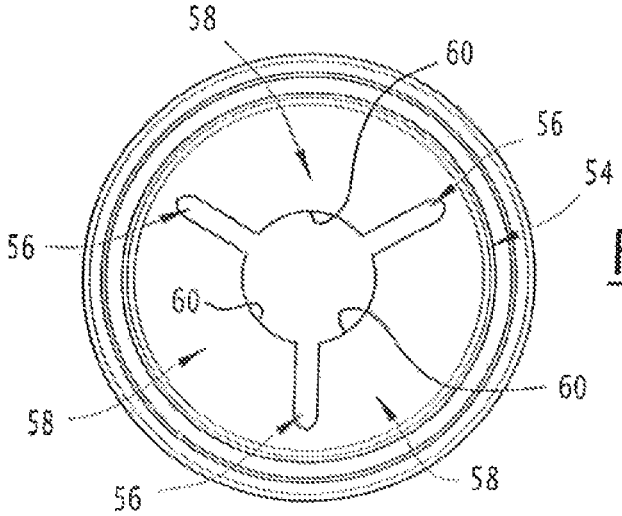
Figure 5:
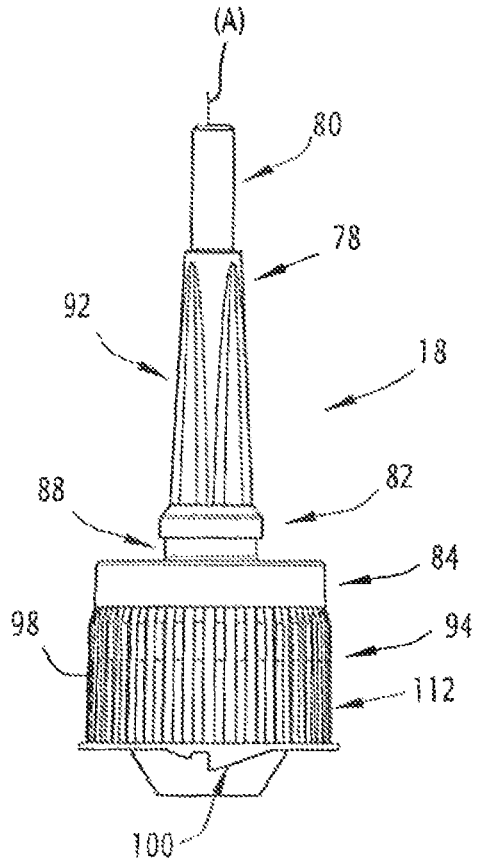
Figure 6:
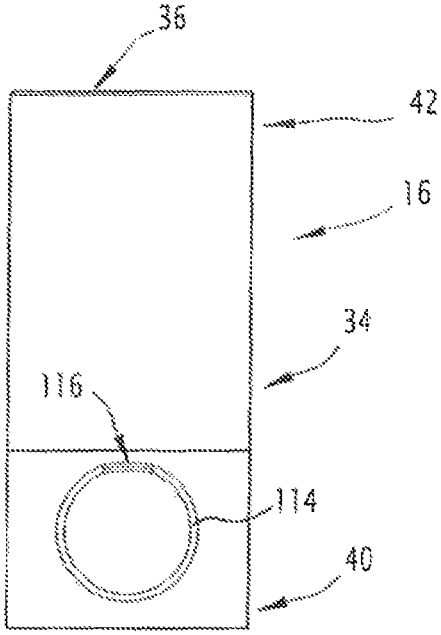
Figure 7:
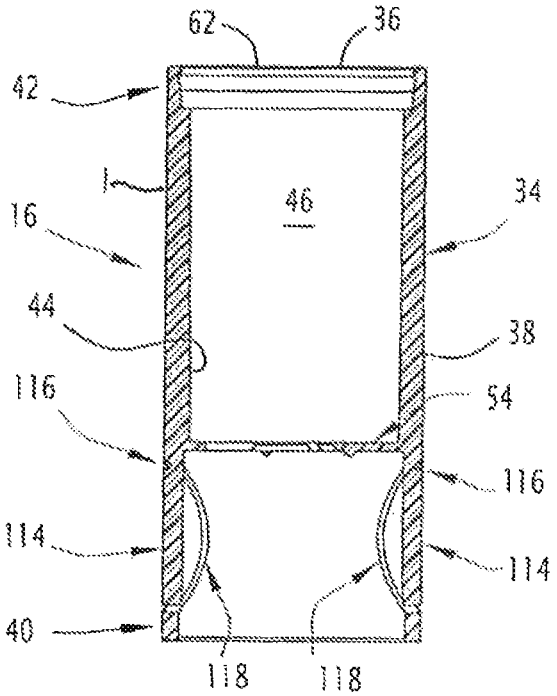

The invention will be easier to understand in view of the following description, provided solely as an example and with reference to the appended drawings, wherein:

FIG. 1 is a diagrammatical view as a longitudinal cross-section of a first device for a packaging and application device for a cosmetic product according to the invention, with the applicator being mounted onto the receptacle, FIG. 2 is a diagrammatical view as a longitudinal cross-section showing a first linear contact region between the rod carrier and the gripping member of the device in FIG. 1, FIG. 3 is a diagrammatical view as a longitudinal cross-section of a second linear contact region between the rod carrier and the gripping member of the device in FIG. 1, FIG. 4 is a diagrammatical view as a transverse cross-section of contact tongues defining the second contact region of the device in FIG. 1, FIG. 5 is a diagrammatic view in elevation of the rod carrier of the device in FIG. 1, FIG. 6 is an outside diagrammatical view of the gripping member of the device of FIG. 1, and FIG. 7 is a sectional diagrammatical view along a median plane of the gripping member of the device in FIG. 1.

A first packaging and application device 10 of the cosmetic product is shown in FIGS. 1 to 7. The device 10 comprises a receptacle 12 intended to contain the cosmetic product, and an applicator 14, removably mounted onto the receptacle 12 and able to apply the cosmetic product.

The cosmetic product is a mascara, a care product, or a cleansing product. In particular, the cosmetic product is a mascara.

The device 10 advantageously has a general cylindrical shape extending along a longitudinal axis (A). The terms "longitudinal" and "radial" are understood generally as relative to the longitudinal axis (A).

In reference to FIG. 1, the receptacle 12 comprises a hollow body 26, able to contain the cosmetic product, and a threaded neck 30 protruding outwards from the body 26 by defining an access opening 28 for the product.

The receptacle 12 also comprises a squeezing device 32 inserted into the neck 30.

The applicator 14 comprises a gripping member 16, extending along the longitudinal axis (A), a rod carrier 18, arranged in the gripping member 16 and mounted mobile in rotation about the longitudinal axis (A) with respect to the gripping member 16.

The applicator 14 also comprises a blocking device 19 that opposes the translation along the axis (A) of the rod carrier 18 with respect to the gripping member 16, a rod 20 integral with the rod carrier 18, a cosmetic product application member 22 carried by the rod 20, and a locking system 24 for the selective rotational locking of the rod carrier 18 with respect to the gripping member 16.

The applicator 14 is mounted mobile between an idle position, wherein is mounted on the recipient 12, the rod 20 and the application member 22 being engaged at least partially in the receptacle 12, and a usage position, in which the rod 20 and the application member 22 are extracted outside of the receptacle 12.

In the idle position, the applicator 14 is maintained fixed on the receptacle 12 for example by screwing on the neck 30.

The gripping member 16 comprises a cover 34 and a plug 36, with the plug 36 here added on the cover 34.

The cover 34 has a shape of revolution about the longitudinal axis (A). It is for example cylindrical.

The cover 34 comprises a peripheral wall 38 about the longitudinal axis (A). It extends between a distal edge 40 intended to be placed facing the receptacle 12 in an idle position of the applicator 14, and a proximal edge 42 intended to be placed apart from the receptacle 12 in the idle position of the applicator 14.

The cover 34 is hollow, and defines an inner surface 44 that delimits an inner volume 46.

In the vicinity of the proximal edge 42 of the cover 34, the inner surface 44 of the cover 34 has a circumferential shoulder 50 of the bearing of the plug 36, shown in FIG. 2, and a protrusion 52 for maintaining the plug 36 in position against the shoulder 50.

In reference to FIGS. 3 and 4, the cover 34 comprises a transverse wall 54, that extends radially from the inner surface 44 of the cover 34.

The transverse wall 54 is arranged longitudinally apart from the proximal edge 42. It defines a plurality of radial slots 56.

The radial slots 56 delimit between them at least two contact tongues 58. The gripping member 16 here comprises three contact tongues 58.

Each tongue 58 radially protrudes from the peripheral wall 38, and more precisely, from the inner surface 44 of the cover 34.

Each tongue 58 defines a free inside edge 60, directed towards the longitudinal axis (A). The free edge 60 has an inner chamfer that converges towards the axis (A) in the direction away from the rod 20 to the plug 36.

In FIG. 2, the plug 36 is securely fastened to the cover 34. It closes the cover 34 on its proximal edge 42.

The plug 36 comprises a sealing wall 62, a peripheral ring 64 for mounting in the cover 34 and an inner sleeve 66 for guiding the rod carrier 18.

The peripheral ring 64 protrudes from the periphery of a distal face 70 of the sealing wall 62.

The peripheral ring 64 comprises at least one attaching stop 72, for example four attaching stops 72 distributed angularly about the longitudinal axis (A).

The peripheral ring 64 is arranged in abutment against the shoulder 50 of the cover 34. Each attaching stop 72 cooperates with the protrusion 52, in order to removably immobilize the plug 36 with respect to the cover 34 and provide an aesthetic aspect.

A proximal face 68 of the sealing wall 62 is flush with the proximal edge 42 of the cover 34.

The inner sleeve 66 protrudes longitudinally in the cover 34 from the distal face 70 of the sealing wall 62.

The inner sleeve 66 delimits an internal cavity 74 and a bulge 76 that protrudes radially towards the longitudinal axis (A) in the internal cavity 74.

The inner sleeve 66 is for example made of acrylonitrile butadiene styrene (ABS), polyoxymethylene (POM), polyethylene (PE), or polypropylene (PP).

The rod carrier 18 is for example made from polybutylene terephthalate (PBT), polyoxymethylene (POM) or polypropylene (PP).

The rod carrier 18 comprises a longitudinal guiding segment 78, extending between a proximal end 80 and a distal end 82, and a head 84 for mounting on the receptacle 12.

The longitudinal segment 78 extends in the internal volume 46 along the longitudinal axis (A). The proximal end 80 is received in the internal cavity 74 defined by the inner sleeve 66.

The rod carrier 18 as such has, on the bulge 76, a first linear contact region 86 with the gripping member 16. The first linear contact region 86 is a circumferential linear contact region about the longitudinal axis (A).

In the example shown, the bulge 76 is continuous in the circumferential direction. The first linear contact region 86 of the rod carrier 18 is as such also continuous in the circumferential direction. Alternatively, the bulge 76 and/or the rod carrier in the first linear contact region is (are) discontinuous in the circumferential direction. The first linear contact region 86 of the rod carrier 18 is as such advantageously discontinuous in the circumferential direction.

The longitudinal segment 78 has, on the first contact region 86, a maximum diameter D1. The maximum diameter D1 is, advantageously between 1.5 mm and 5 mm, in particular between 2.0 mm and 3 mm.

The longitudinal segment 78 also defines a circumferential groove 88 about the longitudinal axis (A) opening radially opposite the longitudinal axis (A).

As can be seen in FIG. 3, the longitudinal segment 78 comprises, at its distal end 82, a flared portion 89A that has an outer chamfer 89B. The circumferential groove 88 is defined in the flared portion 89A of the longitudinal segment 78, between the outer chamfer 89B and the head for mounting 84.

The circumferential groove 88 receives the free edge 60 of each contact tongue 58 of the gripping member 16.

The contact tongues 58 facilitate the assembly of the rod carrier 18 with the gripping member 16, via their snap-fitting into the circumferential groove 88. This assembly is easily obtained by relative translation along the axis A of the gripping member 16 with respect to the rod carrier 18, generating an axial deformation of the contact tongues 56. The cooperation between the inner chamfer on the free end 60 of each contact tongue 58 and the outer chamfer 89B facilitates the snap-fitting.

The longitudinal extend of the groove 88, taken along the axis (A), is greater than the longitudinal extent of the free edge 60, taken along the same axis (A) by at least 10%.

As such, the rod carrier 18 has, on the free edge 60 of each contact tongue 58, a second linear contact region 90 with the gripping member 16. The second linear contact region 90 is a circumferential linear contact region.

In the example shown, the contact tongues 58 are discontinuous in the circumferential direction by being separated from each other by the slots 56. The second linear contact region 90 of the rod carrier 18 is as such also continuous in the circumferential direction. Alternatively, the rod carrier 18 has a contact tongue 58 that is continuous in the circumferential direction forming a continuous annular flange, made of a flexible material in order to allow for the snap-fitting of the rod carrier or associated with a washer for blocking in translation along the axis A integral with the rod carrier 18. Those skilled in the art will be able to determine the material to be chosen for the contact tongue 58 in order to have sufficient flexibility to allow for the snap-fitting of the rod carrier 18, according to the material chosen for the latter. The second linear contact region 90 of the rod carrier 18 is as such also continuous in the circumferential direction.

The first linear contact region 86 and the second linear contact region 90 are separated by a minimum distance l.

The minimum distance l is, for example, greater than 20 mm and is preferably between 23 mm and 60 mm.

The minimum distance l is greater than or equal to two times the average diameter between the diameter D1 of the rod carrier 18 in the first linear contact region 86 and the diameter of the rod carrier 18 in the second linear contact region 90.

The first linear contact region 86 has a contact length l1 taken along the longitudinal axis (A) less than 5%, preferably less than 2% of the minimum distance l separating along the axis (A) the first linear contact region 86 and the second linear contact region 90.

Advantageously, the contact length l1 is less than 5%, preferably less than 2% of the diameter D1 of the longitudinal segment 78 taken on the first contact region 86.

The contact length l1 is as such less than 1 mm, and preferably between 0.05 mm and 0.5 mm.

Likewise, the second linear contact region 90 has a contact length l2 taken along the longitudinal axis (A) less than 5%, preferably less than 2% of the minimum distance l separating along the axis (A) the first linear contact region 86 and the second linear contact region 90.

On the second contact region 90, the circumferential groove 88 has a maximum diameter D2. The maximum diameter D2 is, for example, between 5.50 mm and 6 mm.

Advantageously, the contact length l2 is less than 5%, preferably less than 2% of the maximum diameter D2 of the circumferential groove 88 taken on the second contact region 90.

The contact length l2 is as such less than 1 mm, and preferably between 0.05 mm and 0.5 mm.

Advantageously, the contact regions 86, 90 are adapted so that, when a mechanical stress, resulting in a motion with respect to the longitudinal axis (A), is applied on the application member 22, a rotation of the rod 20 and of the rod carrier 18 with respect to the gripping member 16 is obtained as soon as the motion crosses a limit value.

The longitudinal segment 78 has an intermediate region 92, shown in FIG. 1, defined between the first linear contact region 86 and the second linear contact region 90.

In the intermediate region 92, the rod carrier 18 is arranged entirely separated from the gripping member 16. More particularly, in the intermediate region 92, the rod carrier 18 and the gripping member 16 define a radial gap, measured perpendicularly to the longitudinal axis (A), at least equal to 5%, preferably at least equal to 10%, and more preferably at least equal to 50% of the maximum thickness presented by the rod carrier 18, over at least 50% of the length of the intermediate region 92 taken along the longitudinal axis (A).

The rod carrier 18 and the gripping member 16 have a functional radial gap between them in the first circumferential linear contact region 86 and/or in the second circumferential linear contact region 90.

Preferably, this functional radial gap is less than 0.5 mm, and more preferably less than 0.2 mm and in particular in the neighborhood of 0.1 mm. As such, when the rod carrier 18 and the gripping member 16 are placed coaxially to one another, such as shown in FIGS. 1 to 3, a gap in the radial direction exists on either side of the rod carrier 18, between the rod carrier 18 and the gripping member 16, in the first circumferential linear contact region 86 and/or in the second circumferential linear contact region 90, with this gap substantially corresponding to half of the aforementioned functional radial gap. Advantageously, in the intermediate region 92, the rod carrier 18 and the gripping member 16 define a radial gap, i.e. a gap in the radial direction, greater than or equal to 1.1 times, preferably 1.5 times, the functional radial gap defined between the rod carrier 18 and the gripping member 16 in the first circumferential linear contact region 86 and/or in the second circumferential linear contact region 90, over at least 50% of the length of the intermediate region 92 taken along the longitudinal axis (A). The term "radial gap" in the intermediate region 92 between the rod carrier 18 and the gripping member 16 here means the distance in the radial direction that separates the rod carrier 18 and the gripping member 16 on the intermediate region 92, when these two elements are arranged coaxially. As such, if the functional radial gap between the rod carrier 18 and the gripping member 16 in the first circumferential linear contact region 86 and/or in the second circumferential linear contact region 90 is for example 0.1 mm, then the radial gap between the rod carrier 18 and the gripping member 16 in the intermediate region 92, on one side and the other of the longitudinal axis A when the rod carrier 18 and the gripping member 16 are arranged coaxially, is greater than or equal to 0.11 mm, and preferably greater than or equal to 0.15 mm.

In reference to FIG. 3, the head for mounting 84 of the rod carrier 18 comprises a central ring 93 for fastening the rod 20 and a connecting skirt 94 protruding around the central ring 93. The connecting skirt 94 extends to the distal edge 40 of the cover 34, from the distal end 82 of the longitudinal segment 78.

The inner surface 96 of the connecting ring 94 is threaded, and is able to cooperate with the threading present on the neck 30 of the receptacle 12.

The connecting skirt 94 also comprises a longitudinal protrusion 100, that can be seen in FIG. 5, able to cooperate with a stop 102 of the receptacle 12, which can be seen in FIG. 3, in order to ensure the rotational locking of the rod carrier 18 with respect to the receptacle 12 in idle position.

The ring 94 and the longitudinal segment 78 define a central housing 104. In the example of FIG. 3, the central housing 104 extends to the proximal end 80 of the rod carrier 18 until a bottom 106, arranged longitudinally beyond the circumferential groove 88 of the longitudinal segment 78.

The blocking device 19 is configured to limit the relative translation along the axis A of the rod carrier with respect to the gripping member to a functional gap between these elements. This functional gap is preferably less than 2 mm, in particular less than 1 mm and in particular in the neighborhood of 0.7 mm, even in the neighborhood of 0.5 mm.

The blocking device 19 comprises a first axial stop surface 108A formed on the rod carrier 18, and a second axial stop surface 108B formed by the gripping member 16.

Preferably, the first and second axial stop surfaces 108A, 1088 are adjacent along the axis (A) at one at least of the first and second contact regions 86, 90.

In the example in FIG. 3, they are adjacent to the second contact region 90. The first axial stop surface 108A is as such formed by a shoulder defined in the flared portion 89A by the circumferential groove 88, and the second stop surface 108B is formed by a proximal surface of the transverse wall 54 of the cover 34, on the free edge 60.

The rod 20 is added in the central housing 104.

The application organ 22 is fixed to the free end of the rod 20. The application organ 22 comprises for example a brush 110 that comprises substantial radial bristles.

The locking system 24 for the selective rotational locking of the rod carrier 18 with respect to the gripping member 16 is shown in FIGS. 5 to 7.

The locking system 24 is operable between an inactive configuration, in which the rod carrier 18 is freely rotating about the longitudinal axis (A), and an active configuration, in which the rod carrier 18 is entirely locked in rotation with respect to the gripping member 16. The term entirely locked here means a "frank" contact of elements abutting against one another, and not only a friction contact.

The locking system 24 comprises splines 112 formed on the rod carrier 18, and at least one flexible tab 114 able to cooperate with the splines 112. It comprises, for each flexible tab 114, a flexible hinge 116 for connecting the flexible tab 114 to the cover 34 of the gripping member 16.

The or each flexible tab 114, the flexible hinge 116 and the cover 34 are advantageously from the same material.

The splines 112, which can be seen in FIG. 5, are arranged on an external peripheral surface of the rod carrier 18. In particular, the splines 112 are arranged on an outer surface 98 of the connecting ring 94 of the rod carrier 18.

In the example of FIGS. 6 and 7, the locking system 24 comprises two flexible tabs 114 diametrically opposite with respect to the axis (A).

Each flexible tab 114 is mounted mobile on the gripping member 16.

It is defined by a cut made through the gripping member 16. The cut is here of a rounded shape, for example in the shape of a C.

Each flexible tab 114 comprises at least one locking cog 118 radially protruding towards the axis (A). The locking cog 118 is able to be inserted into a spline 112 in the active configuration of locking, in order to lock the rod carrier 18 in rotation with respect to the gripping member 16. It is arranged entirely apart from the splines 112 in the deactivated configuration.

A process for applying a cosmetic product, for example on keratinous fibers of a user by means of the device 10 shall now be described.

Initially, a device 10 is provided with the applicator 14 in idle position, mounted and immobilized on the receptacle 12.

In order to release the applicator 14 from the receptacle 12, the user locks the rod carrier 18 in rotation with respect to the gripping member 16 by passing the locking system 24 from its inactive configuration to its active configuration.

For this, the user exerts a radial pressure towards the axis (A) on each flexible tab 114. Each locking cog 118 is as such inserted into a spline 112, locking in rotation about the axis (A) the rod carrier 18 with respect to the gripping member 16.

Simultaneously, the user releases the head for mounting 84 from the neck 30 here by unscrewing the unit formed by the gripping member 16 and the rod carrier 18, and by maintaining the locking system 24 active. Then, the user extracts the rod carrier 18 and the application member 22 outside of the receptacle 12 through the opening 28. The squeezing device 32 removes from the brush 110 the excess product that accompanies the exit thereof from the receptacle 12.

The user brings the cosmetic product application member 22 in contact with keratinous fibers.

The user displaces the application member 22 on the keratinous fibers. During this displacement, the mechanical stress of the keratinous fibers on the application member 22 drives in rotation the application member 22, the rod 20, and the rod carrier 18 with respect to the gripping member 16.

The displacement is accompanied by the depositing of the cosmetic product on the keratinous fibers.

The very low contact between the rod carrier 18 and the application member 16 on the regions 86, 90, decreases the friction between the rod carrier 18 and the gripping member 16.

The friction with the keratinous fibers, which are applied on the application member 22 during the application of the cosmetic product, very easily cause the rod 20 to rotate with respect to the gripping member 16.

As such the application member 22, instead of rubbing against the keratinous fibers and removing a portion of the cosmetic product that has already been deposited, rolls on the keratinous fibers and does not remove any of the already deposited cosmetic product. The force exerted by the user to roll the brush on the keratinous fibers is minimized thanks to the pivot connection with reduced statically indeterminate created by the linear contact regions 86, 90.

The application of product is therefore very effective, for a reduced number of contacts with the keratinous fibers. A swelling effect is also produced on the fibers.

Alternatively, the user can selectively rotationally lock of the rod carrier 18 with respect to the gripping member 16 at any time, in particular during the application of the product.

Alternatively, the blocking device 19 is configured to authorize a relative translation travel along the axis A of the rod carrier 18 with respect to the gripping member 16, for example a travel less than 10 mm, in particular between 4 mm and 6 mm.

A damping elastic element (not shown) is for example arranged between the rod carrier 18 and the gripping member 16. This elastic element is arranged in such a way that the relative translation along the axis A is carried out, at least in one direction of translation of the rod carrier 18 with respect to the gripping member 16, against an elastic force exerted by the elastic element.

Alternatively, and according to an advantageous arrangement, the locking system 24 comprises a deformable seal added in the cut around each flexible tab 114, in order to seal the cut at the periphery of each flexible tag 114. Such a seal makes it possible to prevent the insertion of dust into the internal volume 46 of the cover 34.

Alternatively, and according to an advantageous arrangement, the applicator 14 is able to be removably mounted onto the receptacle 12 by means of a snap-fitting or magnetism system, or by any other system that does not require a relative rotation of the applicator 14 with respect to the receptacle 12 in order to separate these two elements.

During the process of application of cosmetic product, the user releases the applicator 14 from the receptacle 12, by pulling on the applicator 14 which is separated from the receptacle 12 via simple translation along the axis (A).

Alternatively, the packaging device is able to be used for the application of a cosmetic product on the epidermis of a user such as a foundation or the application of a cosmetic product on the lips of a user.

The invention claimed is:

1. A cosmetic product applicator including:

a gripping member extending along a longitudinal axis, a rod carrier arranged in the gripping member, a rod secured to the rod carrier, the rod being distinct from the rod carrier and a cosmetic product application member carried by the rod, the rod carrier being mounted on the gripping member such that the cosmetic product applicator has at least one configuration wherein the rod carrier is freely mobile in rotation about the longitudinal axis with respect to the gripping member, wherein the rod carrier has a first circumferentially linear contact region with the gripping member about the longitudinal axis and a second circumferentially linear contact region with the gripping member about the longitudinal axis, the rod carrier having an intermediate region, the intermediate region having a surface extending from the first circumferentially linear contact region and up to the second circumferentially linear contact region, the surface of the intermediate region of the rod carrier being radially arranged totally apart from the gripping member, wherein at least one cross section of the intermediate region of the rod carrier, taken perpendicular to the longitudinal axis, is solid, wherein each circumferentially linear contact region has a contact length taken along the longitudinal axis less than 5% of the minimum distance between the first circumferentially linear contact region and the second circumferentially linear contact region and each circumferentially linear contact region has a contact length taken along the longitudinal axis less than 5% of the maximum diameter of the rod carrier in the circumferentially linear contact region.

2. The applicator according to claim 1, wherein the minimum distance between the first circumferentially linear contact region and the second circumferentially linear contact region is greater than or equal to 2 times an average diameter between diameter of the rod carrier in the first circumferentially linear contact region and a diameter of the rod carrier in the second circumferentially linear contact region.

3. The applicator according to claim 1, wherein the gripping member comprises an inner sleeve, delimiting a cavity in which the rod carrier is received, the inner sleeve comprising a bulge, the first circumferentially linear contact region extending opposite the bulge.

4. The applicator according to claim 1, wherein the gripping member comprises a peripheral wall about the longitudinal axis and at least one contact tongue radially protruding from the peripheral wall, the at least one contact tongue defining a free inner edge directed towards the longitudinal axis, the second circumferentially linear contact region extending opposite the free edge.

5. The applicator according to claim 4, wherein the rod carrier defines a circumferential groove that receives the free edge of the at least one contact tongue.

6. The applicator according to claim 4, wherein the at least one contact tongue includes at least two contact tongues and each of said contact tongues is formed by a transverse wall that defines a plurality of radial slots, the radial slots delimiting between them the at least two contact tongues located facing the second circumferentially linear contact region.

7. The applicator according to claim 1, wherein the gripping member comprises a plug and a cover, the plug being attached to the cover, the first circumferentially linear contact region being delimited opposite the plug, the second circumferentially linear contact region being delimited opposite the cover.

8. The applicator according to claim 1, comprising a locking system for the selective rotational locking of the rod carrier with respect to the gripping member operable between an inactive configuration, in which the rod carrier is freely rotating about the longitudinal axis, and an active configuration, in which the rod carrier is locked against rotation.

9. The applicator according to claim 8, wherein the locking system comprises splines arranged on an external peripheral surface of the rod carrier, and at least one flexible tab mounted mobile on the gripping member, the flexible tab comprising at least one locking cog able to be inserted into at least one of the splines in order to block the rod carrier in rotation with respect to the gripping member.

10. The applicator according to claim 9, wherein the at least one flexible tab is defined by a cut made through the gripping member, the locking system comprising a flexible hinge, the at least one flexible tab being connected to the gripping member by the flexible hinge.

11. The applicator according to claim 10, wherein the locking system comprises a deformable seal arranged in the cut around the at least one flexible tab in order to close off the cut at the periphery of the at least one flexible tab.

12. The applicator according to claim 1, wherein the rod carrier is arranged entirely apart from the gripping member outside of the first circumferentially linear contact region and the second circumferentially linear contact region.

13. The applicator according to claim 1, wherein the rod carrier is locked along any rotation following an axis perpendicular to the longitudinal axis of the gripping member.

14. A packaging and application device for a cosmetic product comprising a receptacle intended to contain a cosmetic product, and an applicator according to claim 1 removably mounted onto the receptacle.

15. A process for applying a cosmetic product on keratinous fibers of a user comprising:

obtaining a device according to claim 14;

detaching the applicator apart from the receptacle;

bringing the cosmetic product application member in contact with the keratinous fibers;

driving in rotation the application member, the rod and the rod carrier with respect to the gripping member by displacing the application member on the keratinous fibers, the rod carrier coming into contact with the gripping member, and depositing the cosmetic product on the keratinous fibers.

16. The process according to claim 15, the applicator comprising a locking system for the selective rotational locking of the rod carrier with respect to the gripping member operable between an inactive configuration, in which the rod carrier is freely rotating about the longitudinal axis, and an active configuration in which the rod carrier is locked in rotation, the process comprising: rotational locking of the rod carrier with respect to the gripping member by passing the locking system from its inactive configuration to its active configuration.

17. The applicator according to claim 1, wherein the contact length is less than 2% of the minimum distance between the first circumferentially linear contact region and the second circumferentially linear contact region or wherein the contact length is less than 2% of the maximum diameter of the rod carrier in the linear contact region.

18. The applicator according to claim 1, wherein each circumferentially linear contact region is annular.

19. The applicator according to claim 1, wherein the first circumferentially linear contact region is defined by a radially outer surface of the rod carrier.

20. A cosmetic product applicator including:

a gripping member extending along a longitudinal axis, a rod carrier arranged in the gripping member, a rod secured to the rod carrier, and a cosmetic product application member carried by the rod, the rod carrier being mounted mobile in rotation about the longitudinal axis with respect to the gripping member, wherein the rod carrier has a first circumferentially linear contact region with the gripping member about the longitudinal axis and a second circumferentially linear contact region with the gripping member about the longitudinal axis, the rod carrier having an intermediate region, the intermediate region having a surface extending from the first circumferentially linear contact region up to the second circumferentially linear contact region, the surface of the intermediate region of the rod carrier being radially arranged totally apart from the gripping member, wherein the rod carrier is blocked in translation along the longitudinal axis with respect to the gripping member, wherein the second circumferentially linear contact region is closer to the cosmetic product application member than the first circumferentially linear contact region, and the second circumferentially linear contact region is defined by a radially outer surface of the rod carrier; and wherein each circumferentially linear contact region has a contact length taken along the longitudinal axis less than 5% of the minimum distance between the first circumferentially linear contact region and the second circumferentially linear contact region and each circumferentially linear contact region has a contact length taken along the longitudinal axis less than 5% of the maximum diameter of the rod carrier in the circumferentially linear contact region.

* * * * *